US011299814B2

(12) United States Patent
Lu et al.

(10) Patent No.: US 11,299,814 B2
(45) Date of Patent: Apr. 12, 2022

(54) METHOD FOR TREATING A SURFACE OF A METALLIC STRUCTURE

(71) Applicant: City University of Hong Kong, Kowloon (HK)

(72) Inventors: Jian Lu, Kowloon (HK); Yang Yang Li, Kowloon (HK); Weihui Ou, Kowloon (HK); Binbin Zhou, Kowloon (HK); Junda Shen, Kowloon (HK); Chenghao Zhao, Kowloon (HK)

(73) Assignee: City University of Hong Kong, Kowloon (HK)

( * ) Notice: Subject to any disclaimer, the term of this patent is extended or adjusted under 35 U.S.C. 154(b) by 261 days.

(21) Appl. No.: 16/668,147

(22) Filed: Oct. 30, 2019

(65) Prior Publication Data

US 2021/0130973 A1 May 6, 2021

(51) Int. Cl.

| | |
|---|---|
| ***C25D 11/02*** | (2006.01) |
| ***C25D 5/00*** | (2006.01) |
| ***C25D 5/18*** | (2006.01) |
| ***C25D 5/34*** | (2006.01) |

(52) U.S. Cl.

CPC ..... *C25D 11/024* (2013.01); *C25D 5/18* (2013.01); *C25D 5/34* (2013.01); *C25D 5/605* (2020.08)

(58) Field of Classification Search

CPC ..... C25D 5/18; C25D 5/605; C25D 5/40

See application file for complete search history.

(56) References Cited

U.S. PATENT DOCUMENTS

| | | | | |
|---|---|---|---|---|
| 10,480,094 | B2 * | 11/2019 | Konopka | C25D 17/02 |
| 10,626,518 | B2 * | 4/2020 | Zhan | C25D 3/56 |
| 2009/0205966 | A1 * | 8/2009 | Kelly | C25D 3/48 205/115 |
| 2010/0126870 | A1 * | 5/2010 | Istvan | C25D 13/02 205/96 |
| 2010/0297904 | A1 * | 11/2010 | Hempelmann | H01M 4/9075 442/187 |

FOREIGN PATENT DOCUMENTS

| | | | | |
|---|---|---|---|---|
| CN | 109722683 A * | 5/2019 | | |
| EP | 3382063 A2 * | 10/2018 | | G01N 21/658 |
| NL | 2009442 A * | 4/2013 | | |
| WO | WO-2017206050 A1 * | 12/2017 | | C25D 3/56 |

* cited by examiner

*Primary Examiner* — Brian W Cohen

(74) *Attorney, Agent, or Firm* — Renner Kenner Greive Bobak Taylor & Weber

(57) ABSTRACT

A method for treating a surface of a metallic structure, the metallic structure being made of a first metallic material, the method including the steps of: (a) releasing metallic ions from the surface of the metallic structure; and (b) depositing a nano-structured metallic layer onto the surface of the metallic structure from the released metallic ions, wherein the nano-structured metallic layer includes uniform nanoparticles.

26 Claims, 14 Drawing Sheets

METHOD FOR TREATING A SURFACE OF A METALLIC STRUCTURE

TECHNICAL FIELD

The present invention relates to a method for treating a surface of a metallic structure and particularly, although not exclusively, to a method for electrochemically treating a surface of a metal-based device so as to obtain a substrate with a nanostructured surface on the metal-based device. The treated structure has improved surface roughness, and can be used as electrodes, filters, absorbers, catalysts, and sensors in various applications.

BACKGROUND

Noble metals with nanoscaled surface textures have attracted intensive interests for promising potential applications, such as catalysis, sensors, actuators, fuel cells, and surface-enhanced Raman spectroscopy. Copious amount of recipes for tailoring metal surface at nanoscale level have been experimentally developed. However, they ubiquitously suffer from either poor structural uniformity or high cost and tedious procedure, which severely restrict their practical application. As a result, current commercial noble metal products generally display poor surface roughness at the macroscopic sale, leading to unsatisfactory device performances.

SUMMARY OF THE INVENTION

In accordance with one aspect of the present invention, there is provided a method for treating a surface of a metallic structure, the metallic structure being made of a first metallic material, the method comprising the steps of: (a) releasing metallic ions from the surface of the metallic structure; and (b) depositing a nano-structured metallic layer onto the surface of the metallic structure from the released metallic ions, wherein the nano-structured metallic layer includes uniform nanoparticles.

In one aspect of the present invention, the surface of the metallic structure is subjected to alternating electrochemical oxidation and reduction through a pulsed voltage or current waveform.

In one aspect of the present invention, metallic atoms of the metallic structure are oxidized to metallic ions thereby releasing from the surface of the metallic structure during oxidation.

In one aspect of the present invention, the metallic ions are reduced to metallic atoms thereby forming the nano-structured metallic layer on the surface of the metallic structure during reduction.

In one aspect of the present invention, the releasing of the metallic ions in step a) is carried out by applying a first voltage for a first duration to the metallic structure; and the deposition of the nano-structured metallic layer in step b) is carried out by applying a second voltage different from the first voltage for a second duration to the metallic structure obtained after step (a).

In one aspect of the present invention, the size of the nanoparticles is manipulated by the first and second voltages and the first and second durations.

In one aspect of the present invention, the first duration and the second duration are each ranged from 0.001 s to 7200 s.

In one aspect of the present invention, the first voltage is a positive or zero voltage, and the second voltage is a negative voltage.

In one aspect of the present invention, the metallic ions released, after step (a), is resided in close contact with the surface of the metallic structure.

In one aspect of the present invention, the first metallic material is formed by a noble metal or an alloy thereof.

In one aspect of the present invention, the alloy further includes a second metallic material and the second metallic material is selected from Cu, Co, Fe, or Ni.

In one aspect of the present invention, an electrochemical cell is used for depositing the nano-structured metallic layer onto the surface of the metallic structure in step (b); the electrochemical cell comprises a first electrode, a second electrode, and an electrolyte in electrical connection, the metallic structure to be treated being connected as the first electrode.

In one aspect of the present invention, the solution of the electrolyte includes an acid.

In one aspect of the present invention, the acid includes at least one of nitric acid and citric acid.

In one aspect of the present invention, the solution of the electrolyte further includes an additive for manipulating the size and morphology of the nanoparticles.

In one aspect of the present invention, the additive includes at least one of acid, metal salts, water soluble polymer, citrate sodium, polystyrene sulfonate, sodium dodecyl sulfate (SDS), and cysteine.

In one aspect of the present invention, the metal salts includes cations and anions; the cations being selected from $Cu^{2+}$, $Ni^{2+}$, $Co^{2+}$, $Fe^{3+}$, and $Fe^{2+}$; the anions being selected from $NO_3^-$, $SO_4^{2-}$, $Cl^-$, and $Br^-$.

In one aspect of the present invention, the water soluble polymer includes polyvinylpyrrolidone (PVP).

In one aspect of the present invention, the nanoparticles of the nano-structured metallic layer form one or more metal nanostructures.

In one aspect of the present invention, the morphologies of metal nanostructures include at least one of nanospheres, nanospindles, nanoplates, nanopyramids, nanowires, nanocones, nanoshuttles, and dendrites.

In one aspect of the present invention, the electrolyte, upon completion of step (b), includes morphologies of nanoparticles of the first metallic material.

In one aspect of the present invention, the morphologies of nanoparticles include at least one of nanocones, nanopyramids, nanorods, nanowires, and nanostars.

In one aspect of the present invention, further includes step d) of separating metallic nanoparticles from electrolyte by centrifugation.

In one aspect of the present invention, further includes step c) of repeating steps a) and b).

In one aspect of the present invention, steps a) and b) are repeated for 10-15000 cycles.

In one aspect of the present invention, further includes step a0), prior to step a) of washing metallic structure via sonication sequentially in acetone, ethanol, and water, each for a predetermined period.

In one aspect of the present invention, further includes step a1), following step a0), of drying the metallic structure under steam of nitrogen.

In one aspect of the present invention, the voltage or current waveform is square-shaped, triangular-shaped, or sinusoidal-shaped.

In one aspect of the present invention, the metallic structure is in the form of a wire, a foil, a mash, a foam, a porous structure or a needle.

In one aspect of the present invention, the metallic structure is a substrate for Surface Enhanced Raman Spectroscopy (SERS), sensing, catalysis, therapeutics or plasmoelectronics.

It is an object of the present invention to address the above needs, to overcome or substantially ameliorate the above disadvantages or, more generally, to provide an improved method for treating a surface of a metallic structure, and in particular, a needle made of noble metals.

BRIEF DESCRIPTION OF THE DRAWINGS

Embodiments of the present invention will now be described, by way of example, with reference to the accompanying drawings in which.

DETAILED DESCRIPTION

The inventors of the present application have devised, through experiments and trials, that existing method for nanostructuring the Ag metals are tedious and ineffective. Such techniques are generally either time-consuming or expensive, let alone the poor morphological uniformity and adjustability. In addition, neither do these techniques may be adopted for coating bulk Ag materials with topological nanostructure surface.

Furthermore, although Surface Enhanced Raman Spectroscopy (SERS) was first found in the electrochemically roughened silver, it has been notoriously difficult to obtain SERS substrates with both high sensitivity and high uniformity, which severely hampered their commercialization. Therefore, silver with topological nanostructure surface attracted increased interest in various fields.

The present invention relates to a facile and robust electrochemical method which bestows Ag metals with nanostructured surface based on the pulse electrochemical techniques in a one-pot one-step manner. Metal nanostructures are constructed at Ag substrate at nanoscale through rapid pulse electrochemistry and as a result, the Ag substrate is evenly coated by various metal nanomaterials. The whole procedure may be carried out in a typical three electrode aqueous system using pulse electrochemistry at ambient conditions. The compositions and specific texture of the thus-created surface is well controlled through adjusting the electrochemical parameters and the electrolyte recipes. Thus, the present invention shows great potential for large scale production.

Figure 1A:
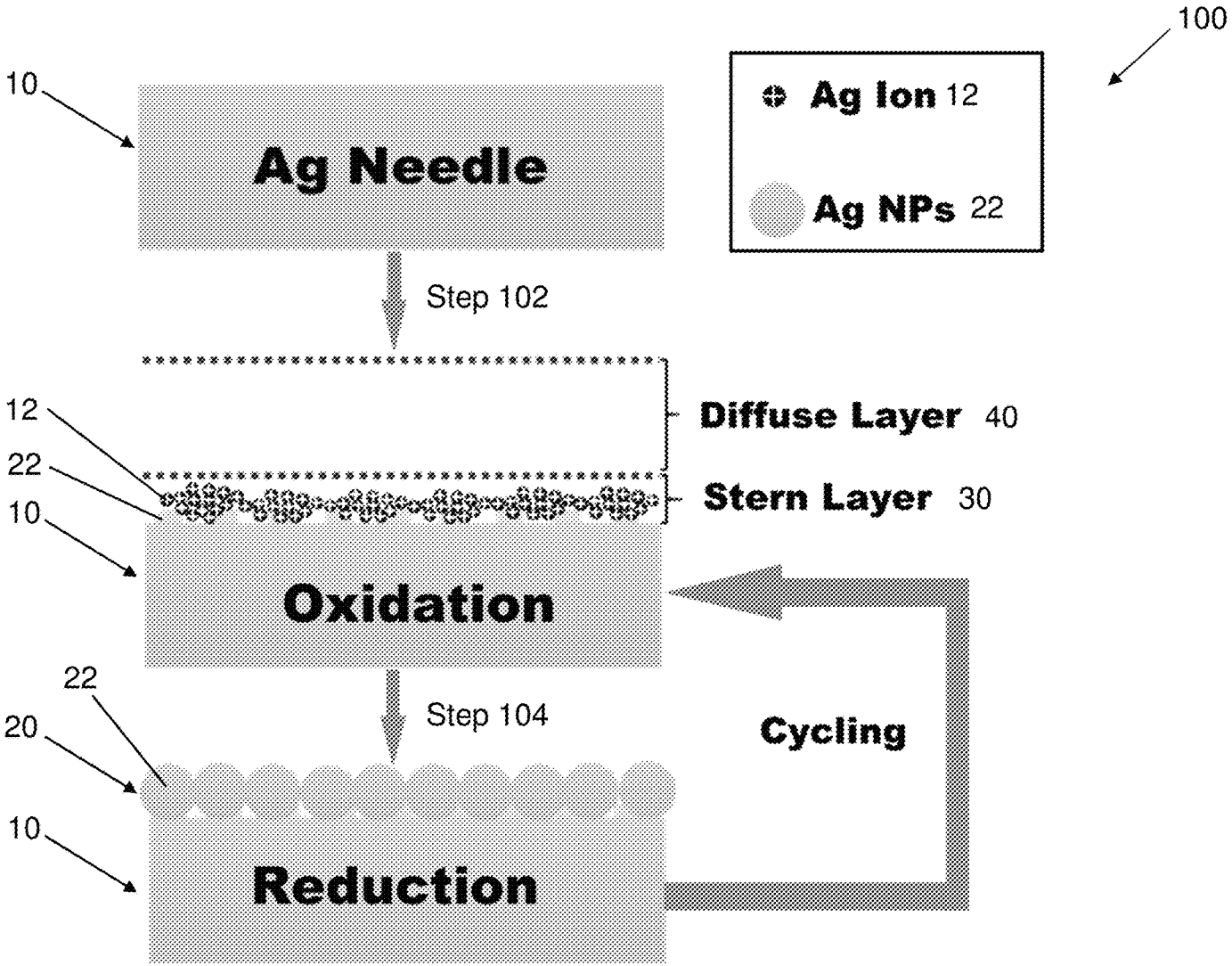
FIG. 1*a* is a flow diagram showing a schematic illustration of fabrication procedure for nanostructuring bulk Ag in accordance with one embodiment of the present invention.

Referring initially to FIG. 1*a*, there is provided a method for treating a surface of a metallic structure 10, the metallic structure 10 being made of a first metallic material, the method comprising the steps of: (a) releasing metallic ions 12 from the surface of the metallic structure 10; and (b) depositing a nano-structured metallic layer 20 onto the surface of the metallic structure 10 from the released metallic ions 12, wherein the nano-structured metallic layer 20 includes uniform nanoparticles 22.

The metallic structure 10 may be embodied in various forms such as a wire, a foil, a mash, a foam, a porous structure or a needle. Essentially, the metallic structure 10 is made of a first metallic material that comprises of a noble metal e.g. Silver or an alloy thereof e.g. Silver with a slight composition of impurities such as Copper, Cobalt, Iron, Nickel etc. The first metallic material may also be a bulk metallic material such as bulk Ag metal. The metallic structure 10 may also form a substrate for Surface Enhanced Raman Spectroscopy (SERS), sensing, catalysis, therapeutics or plasmoelectronics.

There is further provided a nano-structured metallic layer 20 with nanoscaled surface textures at the surface of the metallic structure 10. Preferably, the layer 20 includes a plurality of uniform and densely packed nanoparticles 22, together forming different surface morphologies at nanoscale level on the surface region of the metallic structure 10. The morphologies of nanoparticles 22 may be presented in various forms of nanostructures such as but not limited to nanospheres, nanospindles, nanoplates, nanopyramids, nanowires, nanocones, nanoshuttles, and dendrites etc. Preferably, the nano-structured metallic layer 20 may be made of the first metallic material i.e. Silver or the second metallic material selected from Copper, Cobalt, Iron or Nickel.

The metallic structure 10 may be coated with a nano-structured metallic layer 20 formed by the same metallic material, or alternatively, coated by a different metallic material depending on the composition of the metallic material in the metallic structure 10. To deposit the nano-structured metallic layer 20 onto the metallic structure 10, the metallic structure 10 is subjected to electrochemical treatment under a periodically modulated potential. In particular, the electrochemical treatment involves the alternating electrochemical oxidation and reduction of the metallic structure 10, which may be triggered by applying different first and second voltages or currents to the metallic structure 10 for first and second durations e.g. time ranges from 0.001 s to 7200 s respectively for a number of cycles e.g. 10-15000 cycles. The first voltage is a positive or zero voltage and the second voltage is a negative voltage. For instance, the first voltage may be 0V and the second voltage may be −8V.

Preferably, the voltages or currents waveform may be in the form of square-shaped, triangular-shaped, sinusoidal-shaped or other profiles in which the first and second voltages or currents would remain constant in each cycle. The size of the nanoparticles 20 would be determined by the selection of the applied first and second voltages or currents and corresponding duration.

In one exemplary configuration, the electrochemical treatment of the metallic structure 10 may be performed in an electrochemical cell having a working electrode, a counter electrode and an electrolyte in electrical connection. Optionally, the electrochemical cell may also include a reference electrode, which serves for voltage measurement purpose. A metallic structure 10 made of a first metallic material is used as working electrode and a wire made of a second metallic material is connected to the counter electrode respectively. The solution of the electrolyte is an acid and preferably a diluted acid solution such as nitric acid or citric acid.

The resultant surface nanotexture and ingredients of the nano-structured metallic layer 20 may be further tuned by the presence of additives in the electrolytes. For instance, the electrolyte may further include an additive that may alter the size of the nanoparticles 22 forming the nano-structured metallic layer 20. The additive may be acid, or metal salts. For instance, the cations of the metal salts may be $Cu^{2+}$, $Ni^{2+}$, $Co^{2+}$, $Fe^{3+}$, or $Fe^{2+}$ and the anions of the metal salts may be $NO_3^-$, $SO_4^{2-}$, $Cl^-$, or $Br^-$. The additive may also be water soluble polymer e.g. polyvinylpyrrolidone (PVP), or other compounds such as sodium salts e.g. citrate sodium, sodium dodecyl sulfate (SDS), polysalts e.g. polystyrene sulfonate, or cysteine.

In each cycle, the metallic atoms of the metallic structure 10 are first oxidized to metallic ions 12 and released from the surface of the metallic structure 10 during oxidation stage. In the same cycle, the released metallic ions 12 are then reduced to metallic atoms 22 and form the nano-structured metallic layer 20 at the surface of the metallic structure 10 during reduction stage.

In one example embodiment as shown in FIG. 1*a*, the metallic structure 10 is embodied as a Silver acupuncture needle (SAN) that is suitable for the surface treatment method 100 of the present invention. The SAN 10 is washed via sonication sequentially in acetone, ethanol, and water, each for 15 minutes. After dried under a steam of nitrogen, the SAN is used as the working electrode of the electrochemical cell. On the other hand, a platinum wire acts as the counter electrode and a silver/silver sulfate electrode acts as the reference electrode respectively. The electrolyte is an aqueous solution of 0.1 M nitric acid.

A voltage/current waveform is then applied to the electrochemical cell throughout the electrochemical process. Illustratively, the voltage/current waveform consists of periodically modulated potential/current between two extreme values for n cycles: a potential/current of $P_1/I_1$ for a time duration of $t_1$ for oxidizing Ag structure 10 to release the Ag ion ($Ag^+$) 12, and a potential/current of $P_2/I_1$ for a time duration of $t_2$ for reducing the released Ag ion ($Ag^+$) 12 into Ag nanoparticles 22.

Figure 1B:
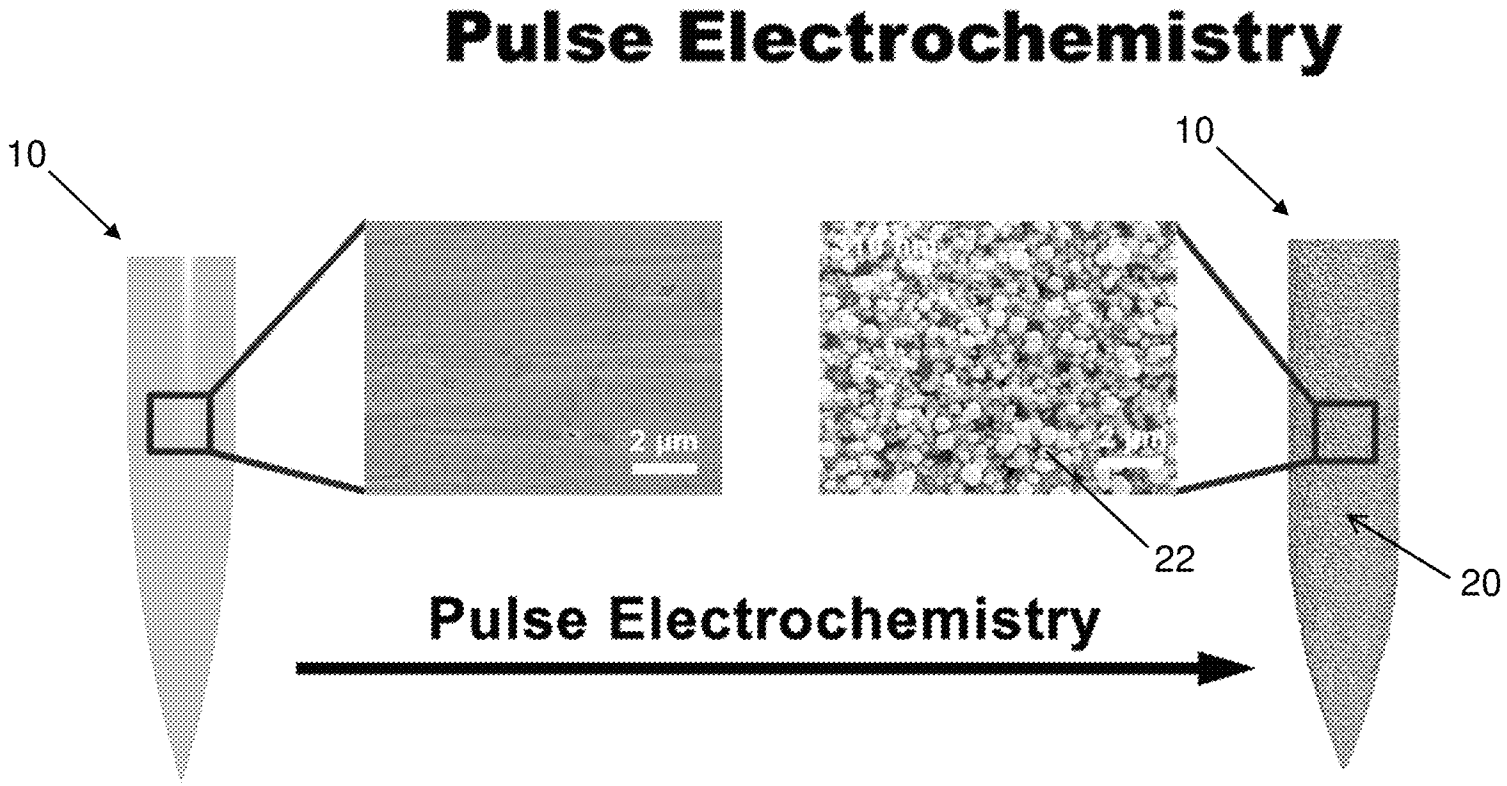
FIG. 1*b* is a schematic diagram showing the surface texture modification of Ag needle with a pulse potential method in accordance with one embodiment of the present invention.

In particular, a pulsed voltage waveform is applied for over 1000 cycles with each cycle consisting of two steps: 0 V (oxidation) for tens of microseconds for releasing the Ag ion ($Ag^+$) 12 in step 102, followed by −0.8 V (reduction) for tens of microseconds to deposit Ag nanoparticles 22 in step 104. Uniform and densely packed Ag nanoparticles in the form of nanospheres 22 with average diameters of 310 nm are then produced at the surface of SAN 10 and deposited as a nano-structured Ag layer 20 as depicted in FIG. 1*b*.

In sharp contrast to conventional roughening techniques, during the ultrashort oxidation step 102, Ag ion ($Ag^+$) 12 released tends to reside in close contact with the surface of the SAN 10 i.e. the stem layer 30, rather than enters the diffusion layer 40 where they would be unevenly distributed, and thus contributes to the narrow size distribution of Ag nanospheres 22 formed in the reduction step 104. On the other hand, the ultrashort reduction step 104 prohibits overgrowth of silver nuclei, which facilitates the formation of uniform and densely packed Ag nanosphere films 20. Naturally, the resultant morphologies are tailorable by modulating the oxidation and reduction steps 102 and 104 respectively.

Figure 1C:
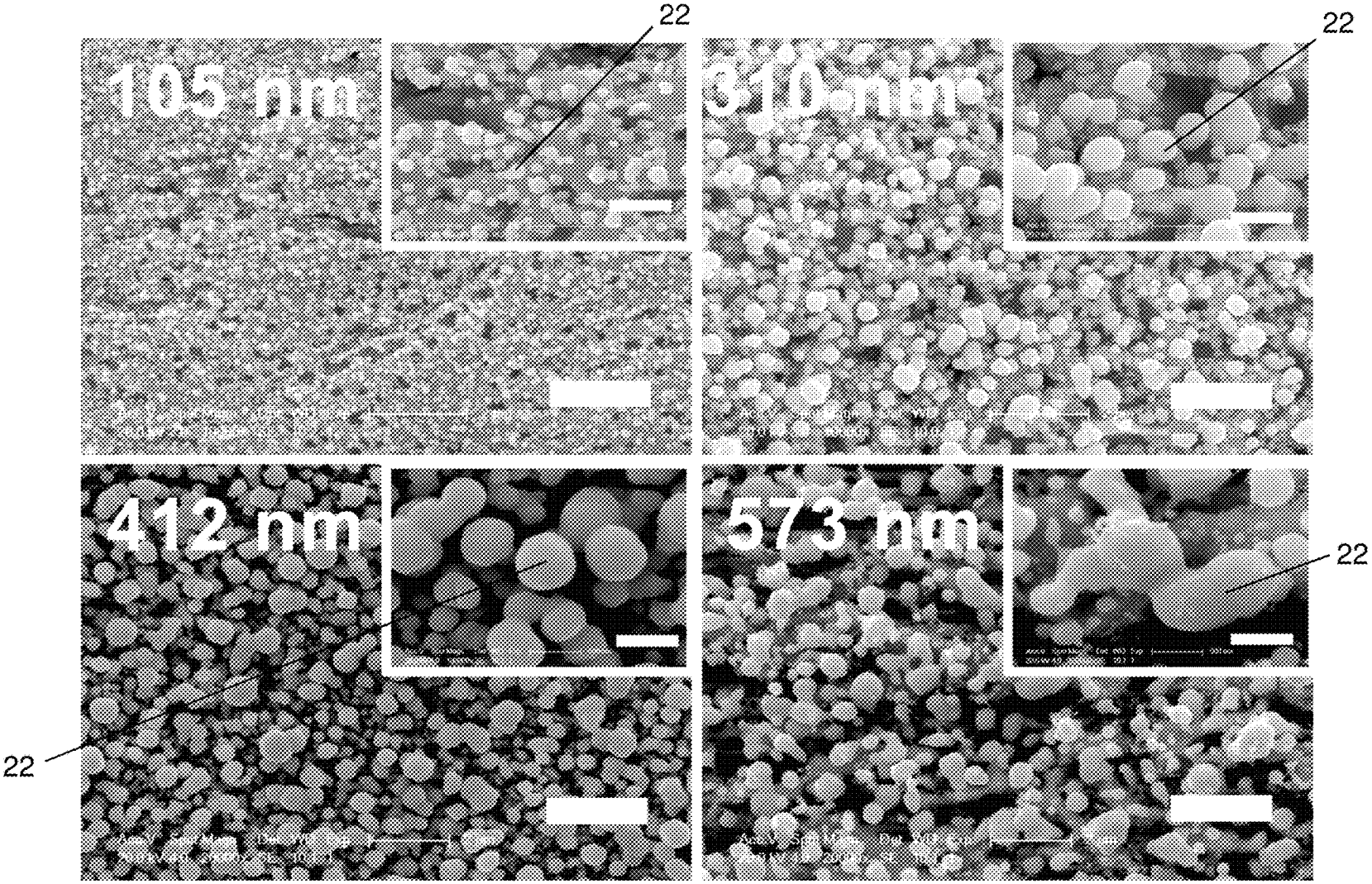
FIG. 1*c* depicts the tuning surface texture of Ag needle from (b) by altering time frames of the pulse.

Advantageously, the dimensions and density of Ag nanosphere 22, i.e., the morphology at the surface 20 of the SAN 10, can be precisely controlled in the range from ~100 to 600 nm as depicted in FIG. 1*c* through altering the electrochemical parameters (e.g., $P_1$, $P_2$, $t_1$ and $t_2$). Four SEM images of nanosphere 22 with different dimensions are depicted in FIG. 1*c*, with scale bars indicate 2 μm and 500 nm for the low and high magnification images respectively.

Figure 1D:
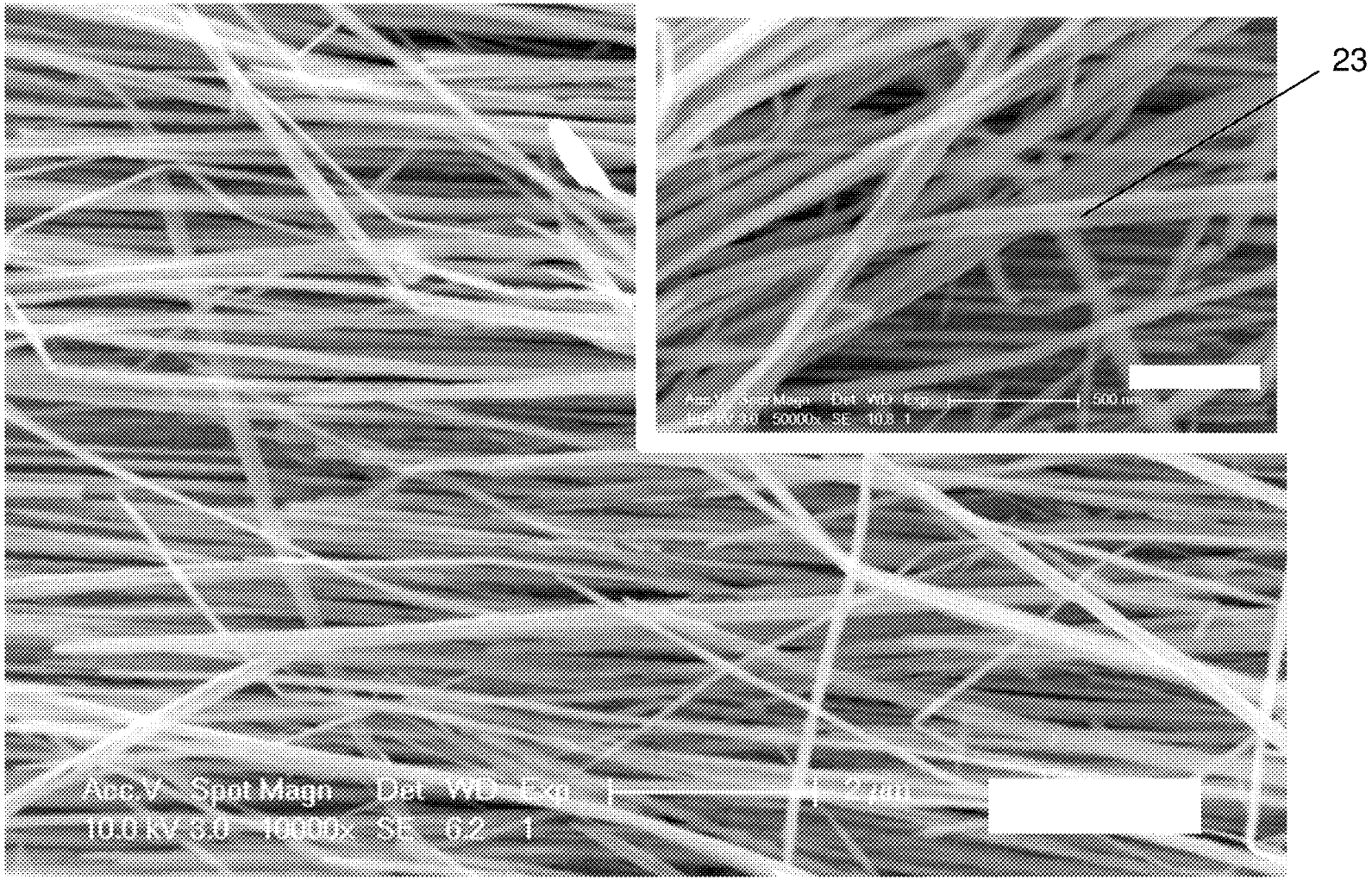
FIG. 1*d* provides SEM images of the surface texture of Ag needle treated with a typical pulse current method.

When a SAN 10 with a small content of Cu is subjected to the electrochemical treatment and cycled under galvanostatic mode i.e. constant current, for instance, between 20 mA ($I_1$) and −20 mA ($I_2$) with dwell time of several seconds for over 100 cycles, in an aqueous solution of 0.05 M citric acid, ultralong ordered Cu nanowires 23 as depicted in FIG. 1*d* are formed on the surface of the SAN 10.

Figure 1E:
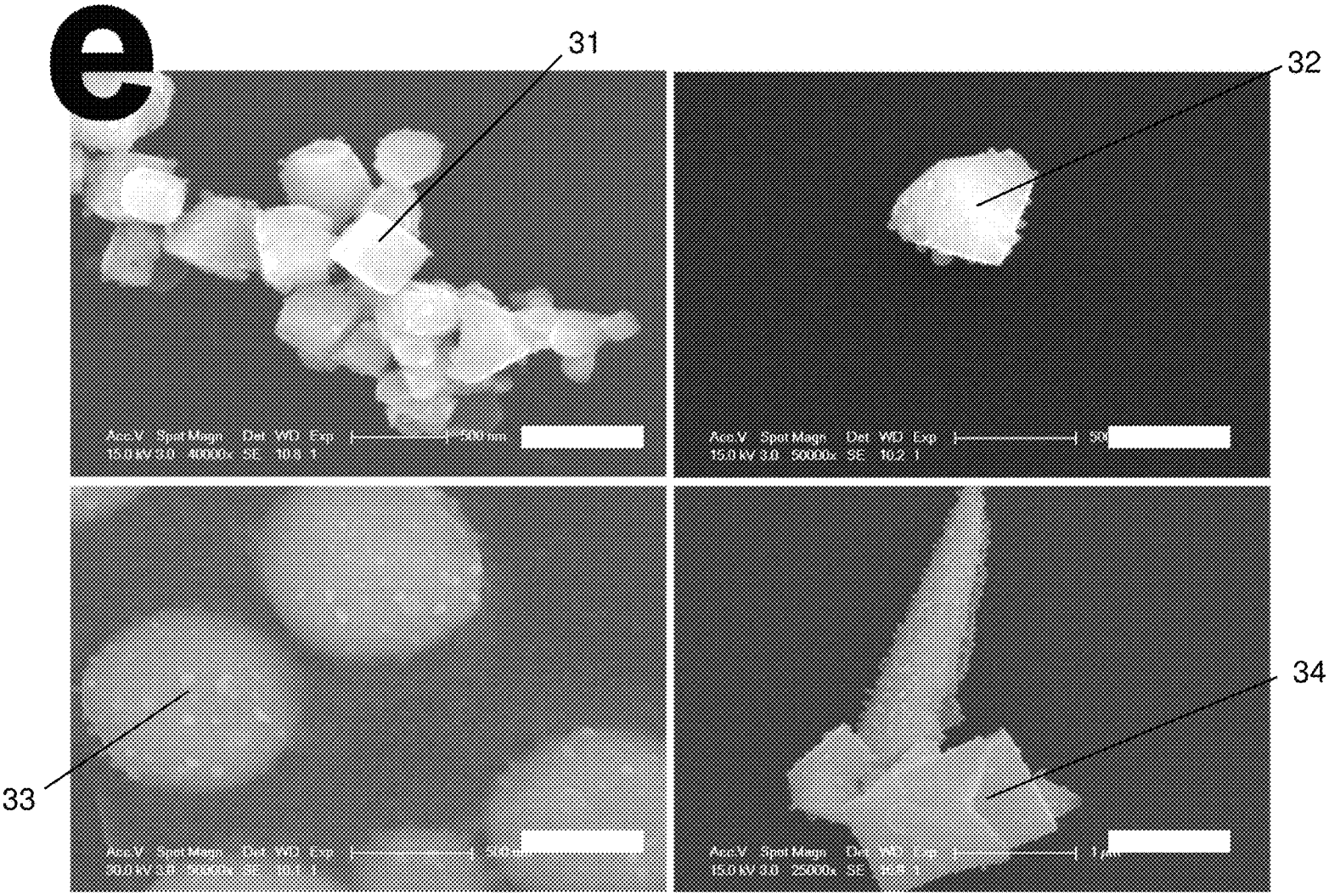
FIG. 1*e* provides typical SEM images of the nanoparticles collected from electrolytes after treatment.

Optionally, various Ag nanoparticles, such as Ag nanocubes 31, nanopyramids 32, nanospheres 33, nanocones 34 as depicted in the SEM images of FIG. 1*e* may also be obtained by centrifugation of resultant electrolytes after the electrochemical treatment.

Figure 2A:
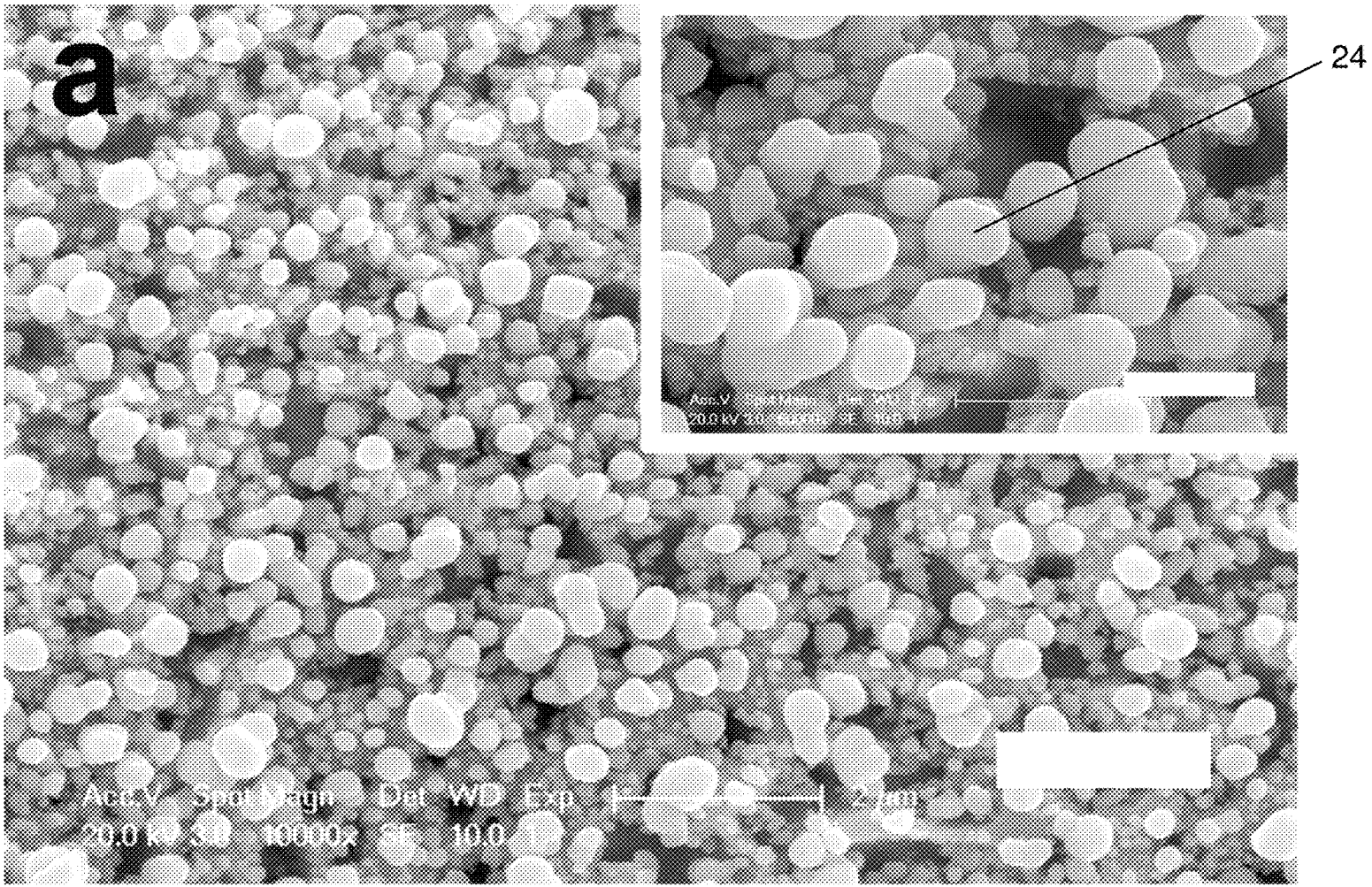
FIG. 2*a* is the SEM image of Ag particles generated in 0.1 M nitric solution without citric acid.
Figure 2B:
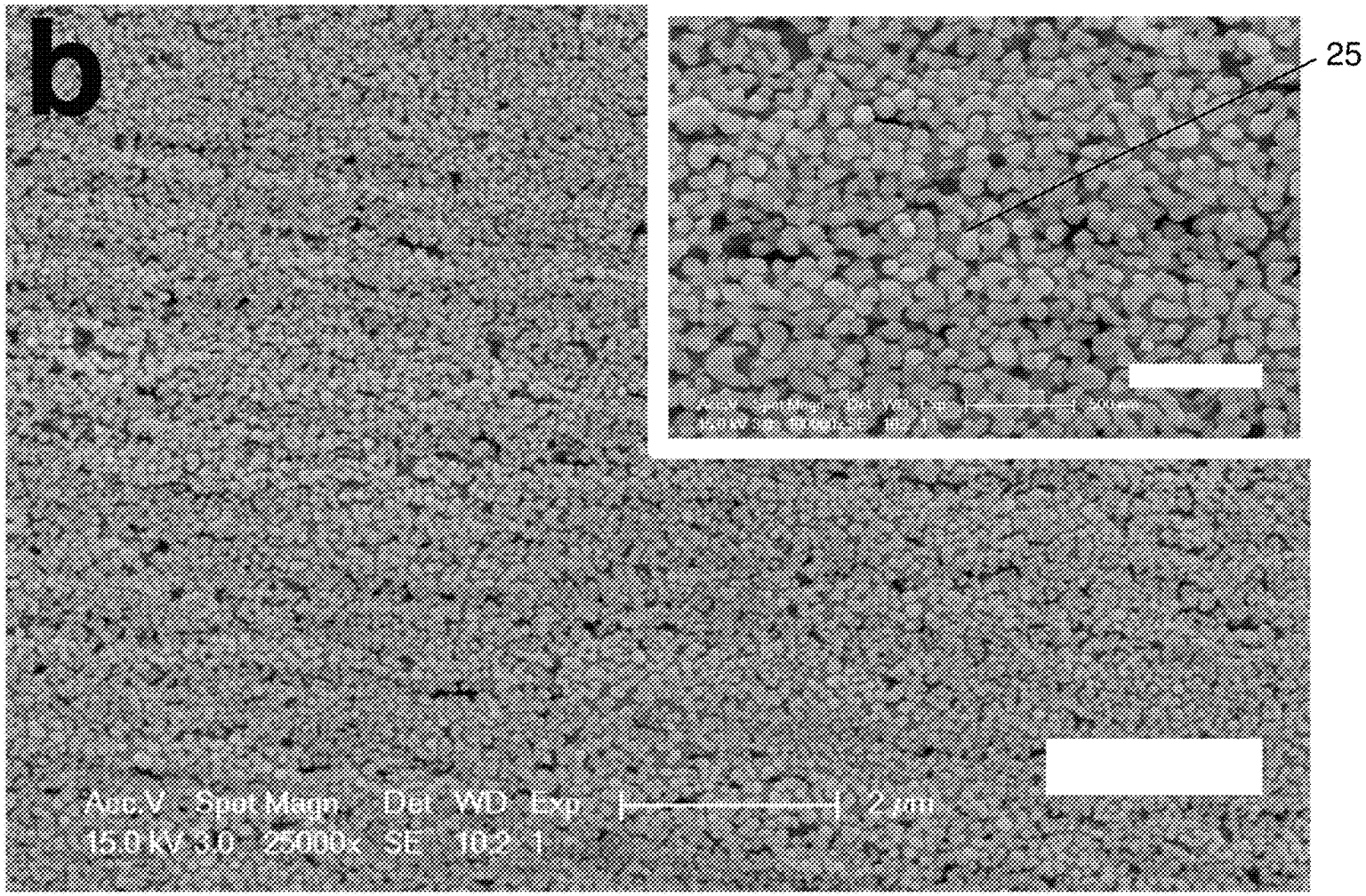
FIG. 2*b* is the SEM image of Ag particles generated in 0.1 M nitric solution with citric acid.
Figure 2C:
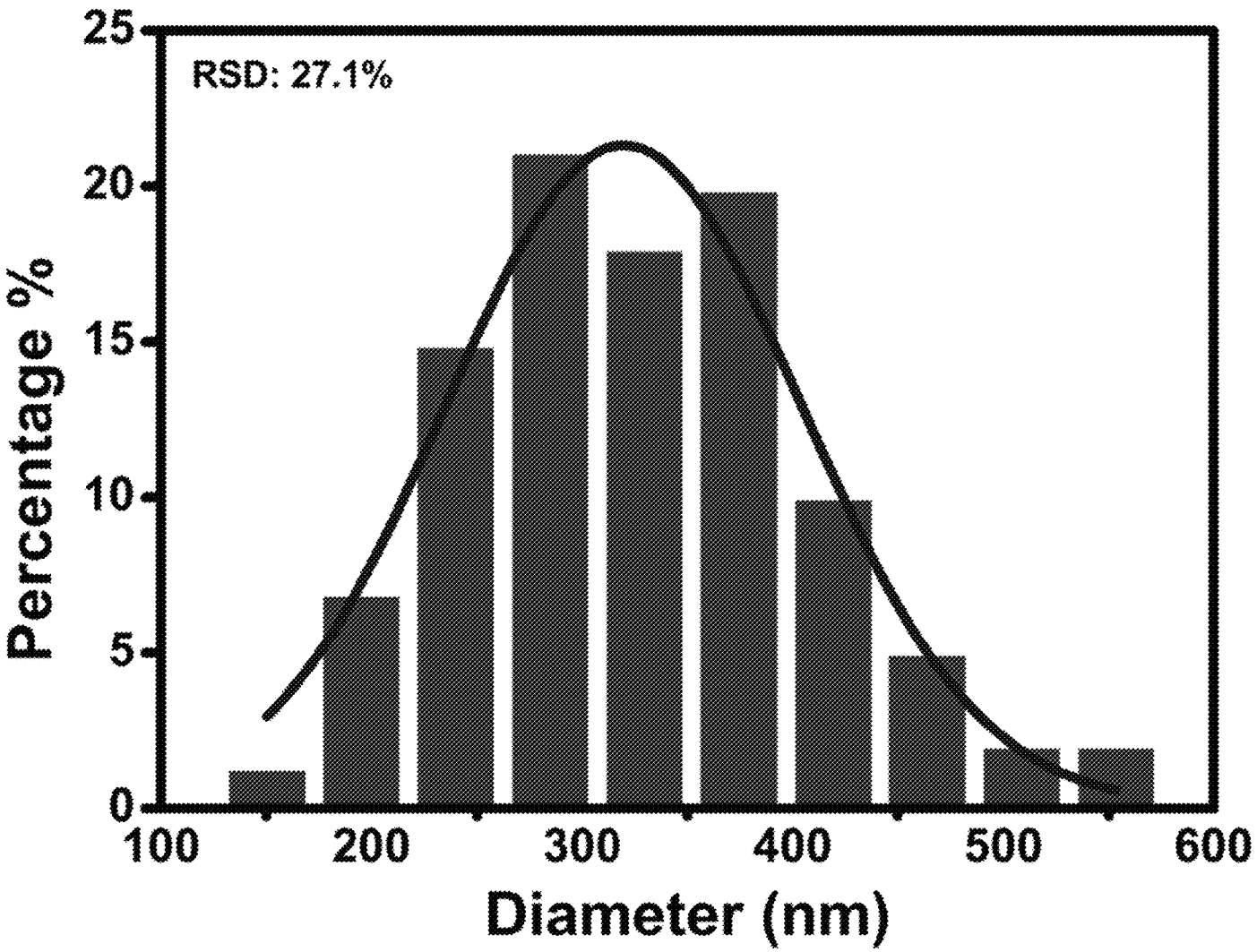
FIG. 2*c* is the size distribution of the Ag particles generated in FIG. 2*a;*
Figure 2D:
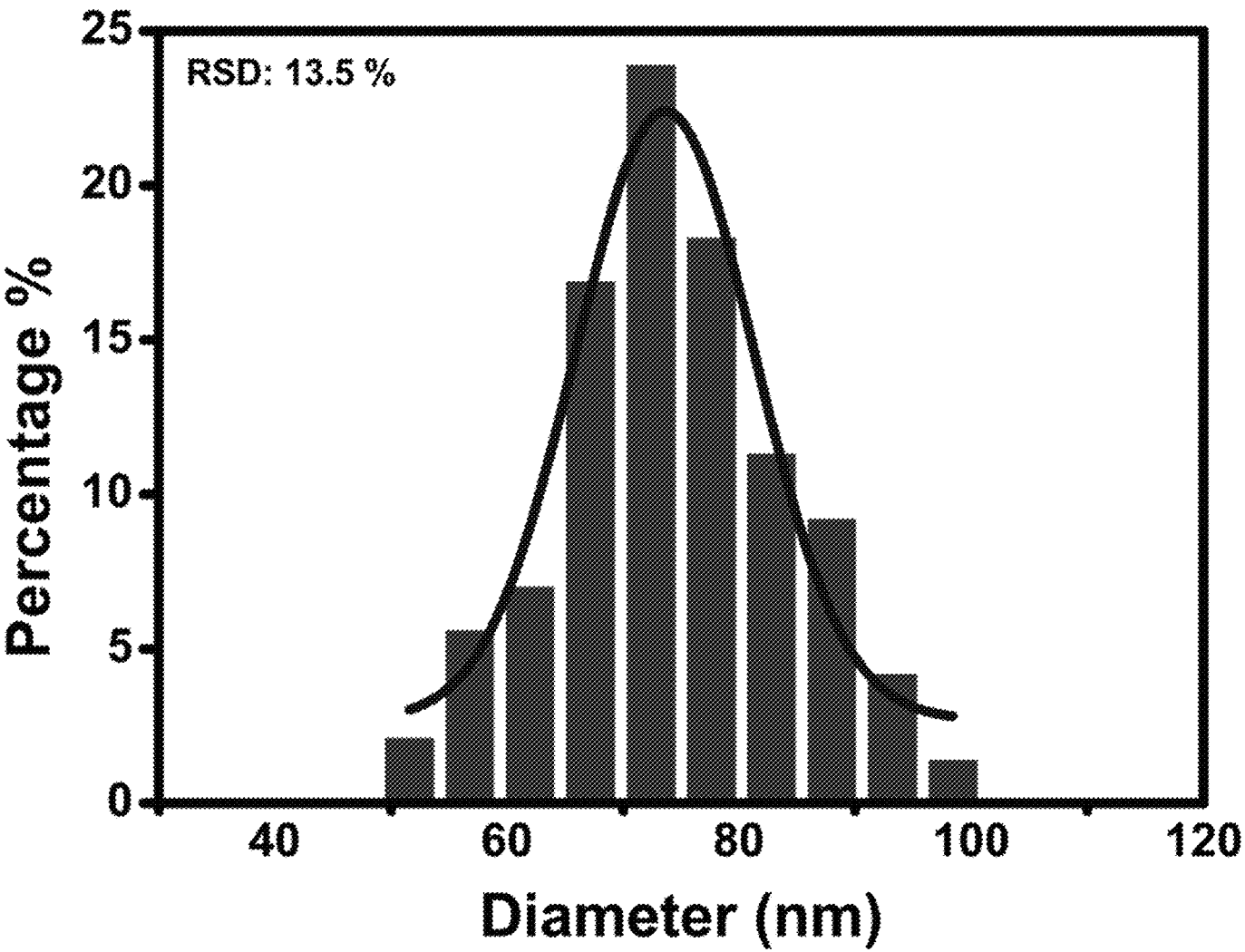
FIG. 2*d* is the size distribution of the Ag particles generated in FIG. 2*b;*

In one alternative embodiment, citric acid is added into electrolyte as additive while the other experimental conditions in the previous example embodiment remained unchanged, nanoparticles 24 of the structured metallic layer 20 formed by electrolyte without additive and nanoparticles 25 of the structured metallic layer 20 formed by electrolyte with additive are depicted in FIGS. 2*a* and 2*b* respectively, with scale bars indicate 2 μm for the low magnification images and 500 nm for insets respectively. Comparing the size distribution chart depicted in FIGS. 2*c* and 2*d*, the average size of silver particles 22 is reduced from 310 nm (size of nanoparticles 24) to 75 nm (size of nanoparticles 25) with relative standard error dropped from 27.1 to 13.5%. Thus, the particle size of the nanostructure 22 can be manipulated by the relative content of the additive within the electrolyte.

The dimensions and aggregates status of the nanostructured surface can be actively controlled by electrochemical parameters and electrolytes compositions/recipes. Accordingly, the final surface texture and density of the thus-created metal nanoparticles 22 can be conveniently manipulated and altered. This greatly enhances the performance of the substrate and the Ag-based devices.

Figure 3A:
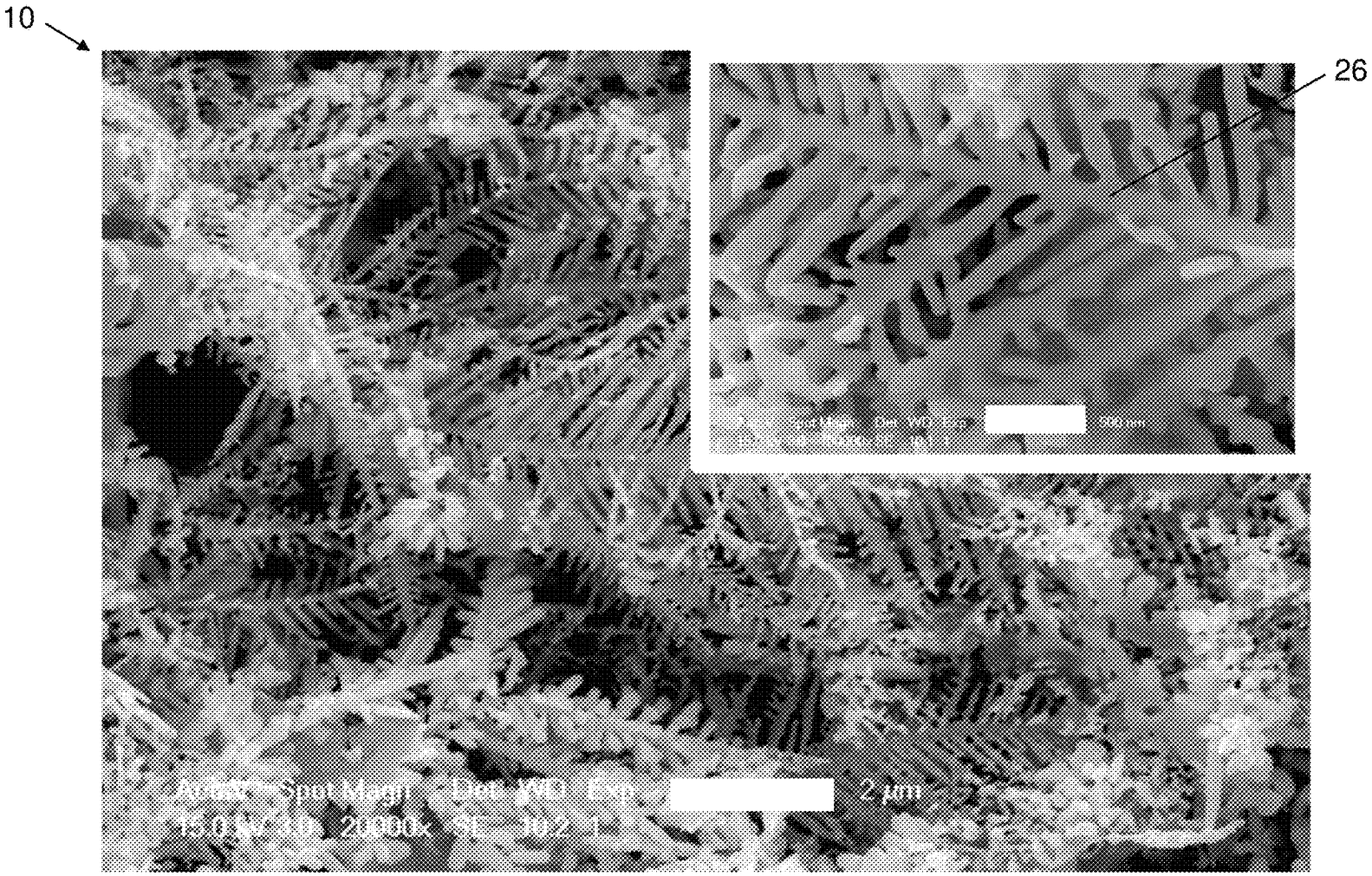
FIG. 3*a* is the SEM image of topological nanotexture at Ag surface generated in 0.1 M nitric solution with a first potential extreme (P1, P2)
Figure 3B:
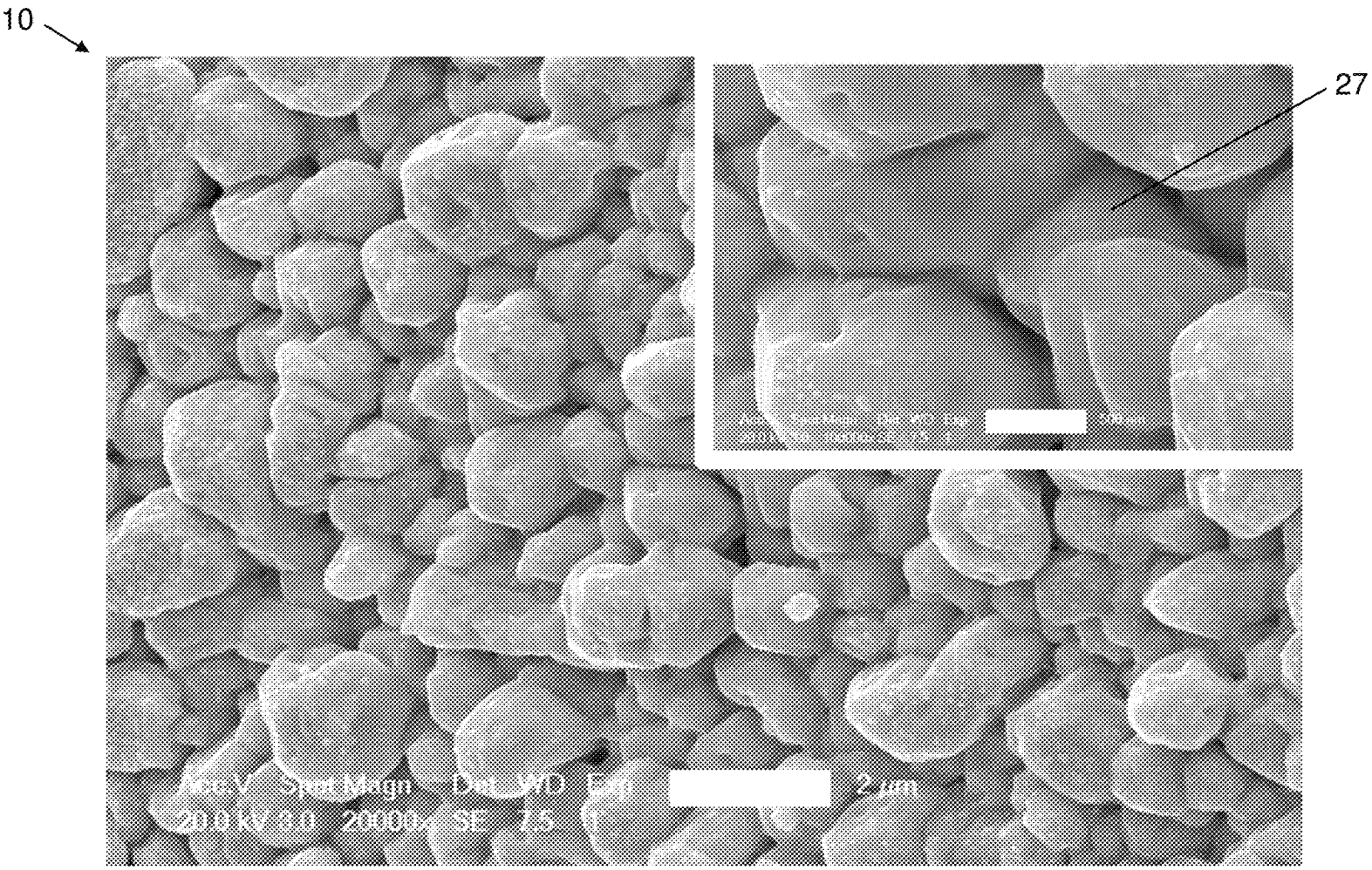
FIG. 3*b* is the SEM image of topological nanotexture at Ag surface generated in 0.1 M nitric solution with a second potential extreme (P1, P2)

In one example embodiment, a pulsed voltage with different potential extremes (P1, P2) are applied to the electrochemical oxidation and reduction. Ag dendrite 26 at nanoscale can be obtained at the surface of the metallic structure 10 as depicted in FIG. 3*a* and Ag hill-and-valley structure 27 at nanoscale can be obtained at the surface of the metallic structure 10 as depicted in FIG. 3*b* respectively.

Figure 3C:
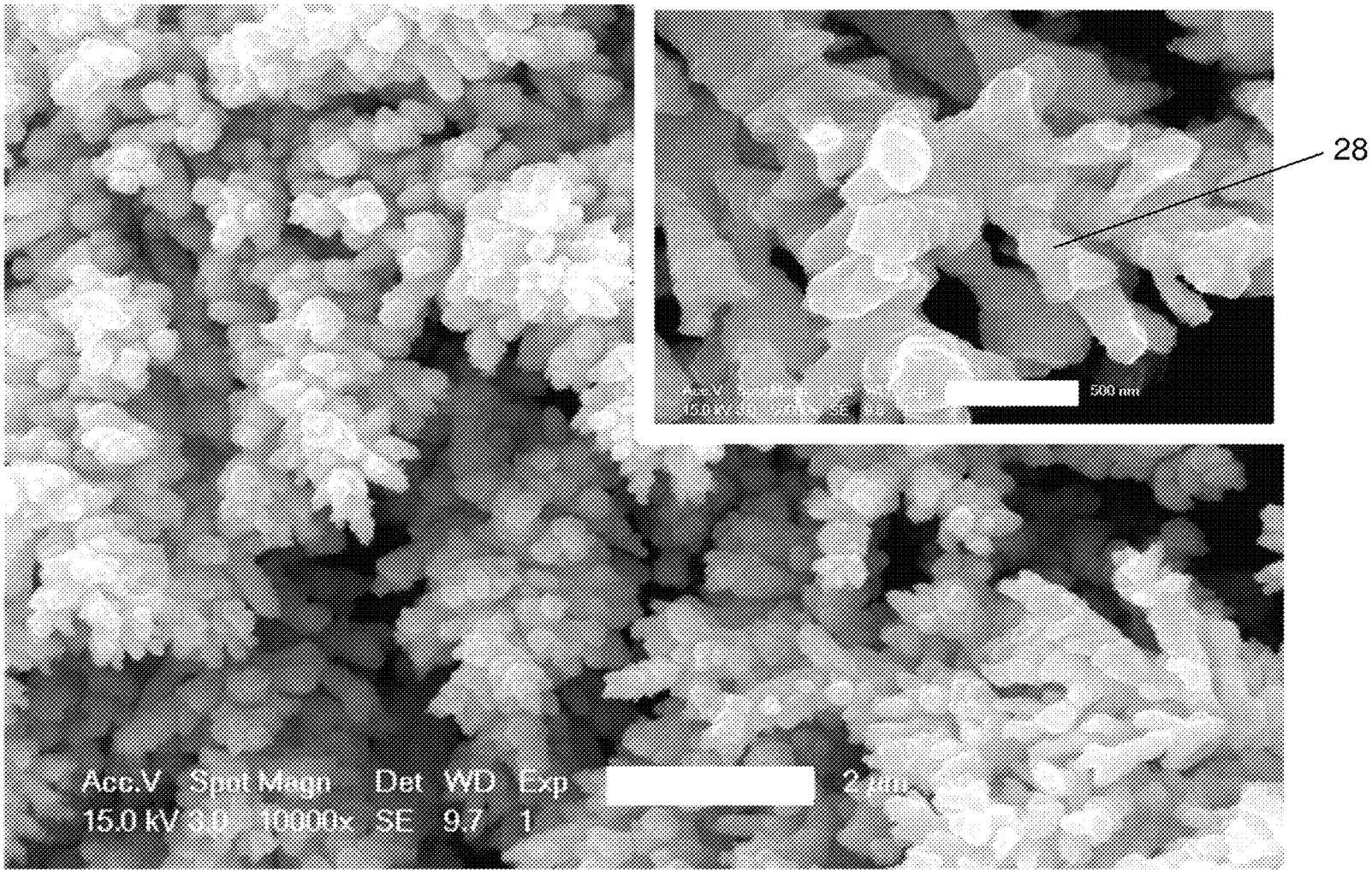
FIG. 3*c* is the SEM image of Cu nanomaterials formed at Ag surface by adding Cu salts to nitric solution.
Figure 3D:
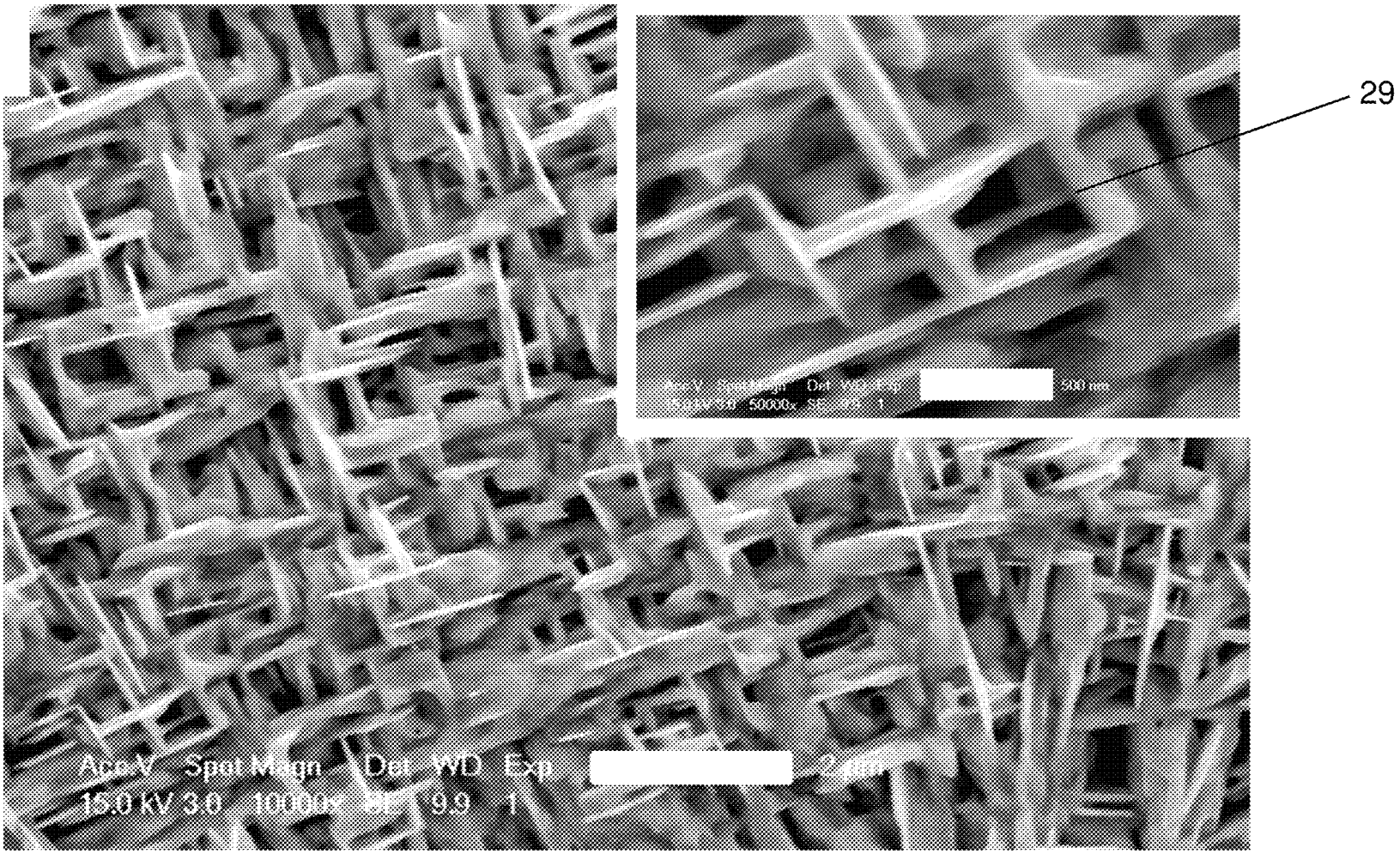
FIG. 3*d* is the SEM image of Cu nanomaterials formed at Ag surface by adding Cu salts to nitric solution.

In another example embodiment, upon the Cu salts are added into electrolyte during electrochemical oxidation and reduction, grapes-like Cu nanomaterials 28 and vertically aligned Cu nanoplates 29 are formed at surface of Ag and as depicted in FIGS. 3*c* and 3*d* respectively.

Preferably, Ag metals 10 featuring nanostructured surface 20 is suitable for many different fields, such as energy storage and conversion, sensing, and surface-enhanced Raman spectroscopy (SERS). The SERS performance of SAN obtained from the present invention is evaluated whereas the feasibility and advantages of the invented techniques for nanostructuring the surface of SAN is demonstrated.

In one example embodiment, Ag acupuncture needle (SAN) 10 is treated with the method in accordance with the present invention ($P_1$=0 V, $P_2$=−0.8 V, $t_1$=$t_2$=0.02 s, 1600 cycles). The SANs 10 are readily coated with a layer of densely packed Ag nanospheres 22, which are either uniform in size or at least has a very narrow size distribution.

Figure 4:
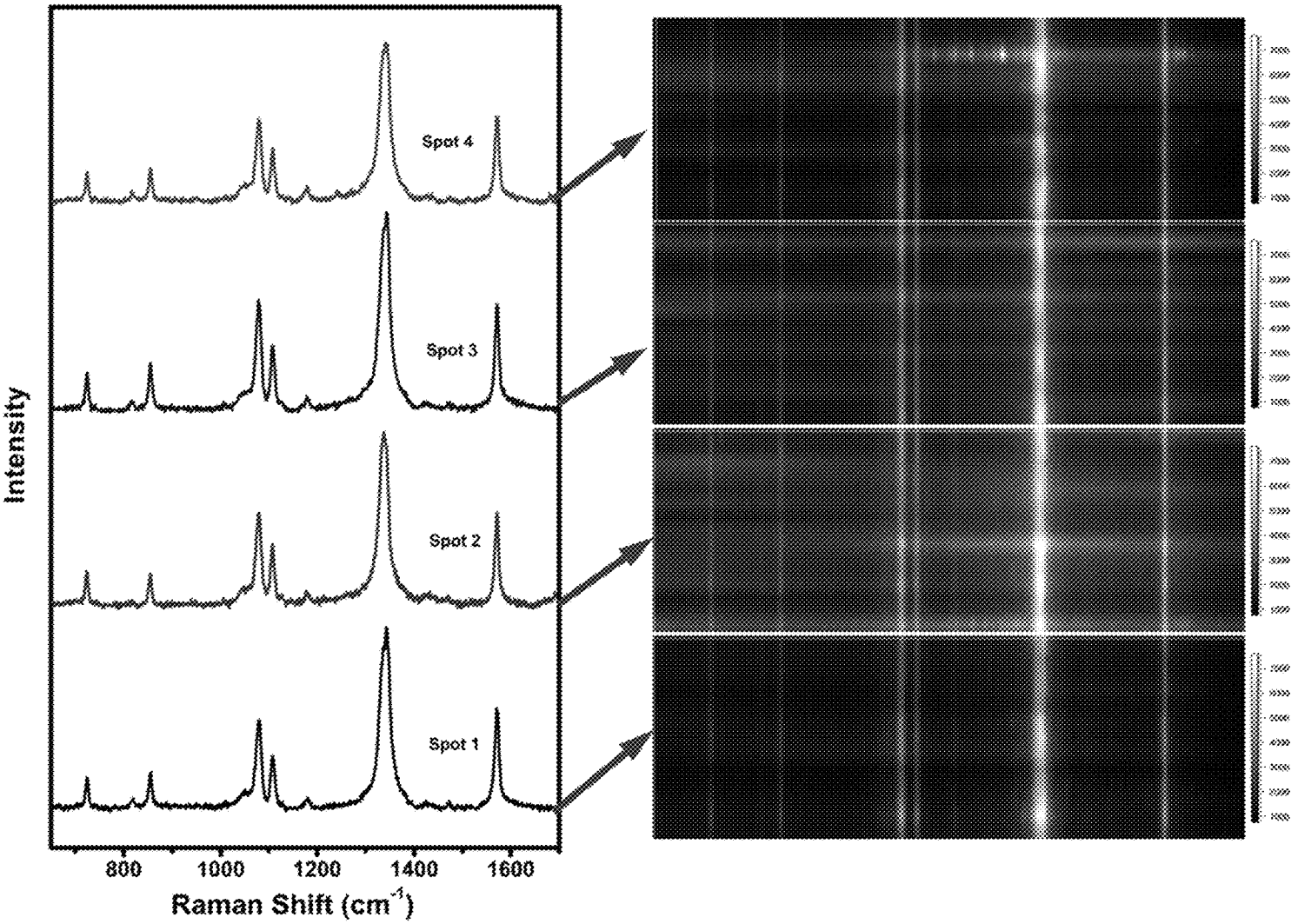
FIG. 4 is a SERS spectra and mapping images collected from different areas of the treated Ag needle after soaking in the $10^{-4}$ M 4-NTP for 20 min.

The treated needle 10 is then applied as an enhanced SERS substrate for trace analysis and detection of 4-nitrothiophenol (4-NTP), a commonly used Raman reporter/label. After soaking in $10^{-4}$ M 4-NTP for 10 minutes, Raman signals of 4-NTP absorbed at SAN from different spots on the substrate and the mapping images (2 μm stepwise) were recorded, showing excellent reproducibility (FIG. 4). The detection limit was found to be as low as $10^{-8}$ M. Thus, the present method exhibited a detection limit five orders of magnitude lower and shows enhanced Raman signals with a much improved reproducibility/repeatability (SD<15%) for trace detection of 4-NTP over untreated ones. Thus, the SERS substrate is conspicuously superior to the common commercial SERS substrates.

These observed remarkable enhancement behaviors are ascribed to the densely packed Ag nanospheres 22 on the surface 20, which substantially amplify the near electric field, creating a large quantity of hot spots for Raman enhancement. As the "hot spots" are evenly distributed on the surface 20, uniform and densely packed Ag nanospheres 22 can be utilized as the sensitive SERS substrate with excellent reproducibility.

Overall, the SAN 10 with nanostructured surface 20 obtained here is very promising for commercial SERS substrate for rapid and label-free detection. The method of the present invention is convenient, cost-efficient, environmentally friendly and amendable to mass production, which hold great potential for fundamental investigation and practical applications.

Some technical advantages of the embodiments of the present invention include:

- The whole treatment progress is accomplished in a simple aqueous three electrode system at ambient conditions in a one-pot one-step manner. Neither harsh conditions such as vacuum and clean room nor sophisticated and expensive control systems which are generally required by other micro-processing technologies are needed.
- Silver metals acted as silver resources and deposit substrate at the same time. By contrast, for the previous methods, expensive silver salts are needed.
- Remarkable morphological uniformity of Ag nanostructure is conveniently achieved, due to the localization of $Ag^+$ in the stem layer and the suppressed growth of Ag nanoparticles enabled by the pulsed oxidation and reduction.
- Fine control of surface nanotextures and compositions are easily realized by adjusting the electrochemical parameters and additives in the electrolytes.
- A wide range of metal microstructures such as nanoneedles, nanowires, nanosheets, nanocubes, and nanopores, dendrites, and grapes, can be conveniently fabricated.

Further/other advantages of the present invention in terms of cost, structure, function, ease of manufacture, economics, etc., will become evident to a person skilled in the art upon reading the above description and the reference drawings.

Embodiments of the present invention can be applied to various applications and fields, for example:

SERS substrates

Embodiments of the present invention can be used to produce Ag needle with tailorable advanced nanostructures, making them attractive SERS substrates. Especially, such novel SERS substrate can be readily inserted into sample, facilitating sampling process, which is favorable for fast analysis.

Industrial Catalyst

Embodiments of the present invention can be used to provide Ag materials with remarkably increased surface volume ratio, i.e. active catalytic sites. This shows a great potential in various catalysis reaction. Furthermore, the metal nanoparticles on silver are free from other surfactants or reductants, reducing reaction activation energy barriers and thus leading to better catalytic efficiency.

Photovoltaic device

Ag nanoparticles exhibit extraordinary UV-vis light absorption, enabled by surface plasmon resonance, which is very promising for solar energy conversion and storage Supercapacitors Embodiments of the present invention can be used to provide electrode substrate materials e.g. Ag substrates for supercapacitors.

Sensors

Embodiments of the present invention can be used to deliver enhanced performance for nanostructured materials e.g. Ag substrates that are used as electrode in sensors.

Electrocatalysis

Embodiments of the present invention can be used to provide Ag substrates with enhanced performance for electrode in electrocatalysis.

Photocatalyst

Embodiments of the present invention can be used to form Ag topological nanostructure in dilute nitric solution. Neither contaminants nor surfactants, commonly used in the synthesis of colloid Ag, are present at the surface of Ag, which is favorable for reducing chemical trap sites for electron transfer during catalysis reaction.

Spectroscopy and Plasmoelectronics

Embodiments of the present invention can also be used to provide nanostructured silver-based materials that are stable and show vitally important physical and chemical properties. Ag-based materials with metal nanotexture at surface obtained by the present invention show great potential in a wide range of other applications in spectroscopy and plasmoelectronics, etc.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A method for treating a surface of a metallic structure, the method comprising the steps of:

(a) releasing metallic ions from the surface of the metallic structure, the metallic structure comprising a first metallic material selected from the group consisting essentially of silver metal, a silver alloy, and a combination thereof; and (b) depositing the released metallic ions onto the surface of the metallic structure to form a nano-structured metallic layer, wherein the nano-structured metallic layer includes uniform nanoparticles, wherein the size of the nanoparticles is in a range between 100 to 600 nm;

wherein the method is performed using an electrochemical cell comprising a first electrode, a second electrode, and an electrolyte in electrical connection with the first electrode and the second electrode, wherein the metallic structure to be treated is connected as the first electrode, and wherein prior to step (a) the electrolyte does not contain the metallic ions to be deposited.

2. The method of claim 1, wherein the surface of the metallic structure is subjected to alternating electrochemical oxidation and reduction through a pulsed voltage or current waveform.

3. The method of claim 2, wherein metallic atoms of the metallic structure are oxidized to metallic ions thereby releasing from the surface of the metallic structure during oxidation.

4. The method of claim 2, wherein the metallic ions are reduced to metallic atoms thereby forming the nano-structured metallic layer on the surface of the metallic structure during reduction.

5. The method of claim 1, wherein the releasing of the metallic ions in step a) is carried out by applying a first voltage for a first duration to the metallic structure; and the deposition of the released metallic ions in step b) is carried out by applying a second voltage different from the first voltage for a second duration to the metallic structure obtained after step (a).

6. The method of claim 5, wherein the size of the nanoparticles is manipulated by the first and second voltages and the first and second durations.

7. The method of claim 5, wherein the first duration and the second duration are each ranged from 0.001 s to 7200 s.

8. The method of claim 5, wherein the first voltage is a positive or zero voltage, and the second voltage is a negative voltage.

9. The method of claim 1 wherein the silver alloy further includes a second metallic material and the second metallic material is selected from Cu, Co, Fe, or Ni.

10. The method of claim 1 wherein the electrolyte includes an acid.

11. The method of claim 10, wherein the acid includes at least one of nitric acid and citric acid.

12. The method of claim 1, wherein the electrolyte further includes an additive for manipulating the size of the nanoparticles.

13. The method of claim 12, wherein the additive includes at least one of acid, water soluble polymer, sodium citrate, polystyrene sulfonate, sodium dodecyl sulfate (SDS), and cysteine.

14. The method of claim 13, wherein the water soluble polymer includes polyvinylpyrrolidone (PVP) or polystyrene sulfonate.

15. The method of claim 1, wherein the nanoparticles of the nano-structured metallic layer form one or more metal nanostructures.

16. The method of claim 15, wherein the morphologies of metal nanostructures include at least one of nanospheres, nanospindles, nanoplates, nanopyramids, nanowires, nanocones, nanoshuttles, and dendrites.

17. The method of claim 1 wherein the electrolyte, upon completion of step (b), includes morphologies of nanoparticles of the first metallic material.

18. The method of claim 17, wherein the morphologies of nanoparticles include at least one of nanocones, nanopyramids, nanorods, nanowires, and nanostars.

19. The method of claim 1, further including step d) of separating metallic nanoparticles from the electrolyte by centrifugation.

20. The method of claim 1, further including step c) of repeating steps a) and b).

21. The method of claim 20, wherein steps a) and b) are repeated for 10-15000 cycles.

22. The method of claim 1, further including step a0), prior to step a), of washing the metallic structure via sonication sequentially in acetone, ethanol, and water, each for a predetermined period.

23. The method of claim 22, further including step a1), following step a0), of drying the metallic structure under steam of nitrogen.

24. The method of claim 2, wherein the voltage or current waveform is square-shaped, triangular-shaped, or sinusoidal-shaped.

25. The method of claim 1, wherein the metallic structure is in the form of a wire, a foil, a mesh, a foam, a porous structure or a needle.

26. The method of claim 1, wherein the metallic structure is a substrate for Surface Enhanced Raman Spectroscopy (SERS), sensing, catalysis, therapeutics or plasmoelectronics.

* * * * *